United States Patent [19]

Pomponio

[11] Patent Number: 4,656,451

[45] Date of Patent: Apr. 7, 1987

[54] ELECTRONIC NOISE SUPPRESSOR

[75] Inventor: Thomas F. Pomponio, Rochester, N.Y.

[73] Assignee: Ferronics, Inc., East Rochester, N.Y.

[21] Appl. No.: 821,782

[22] Filed: Jan. 23, 1986

[51] Int. Cl.[4] ..... H01F 17/06; H01F 27/26; H01F 27/30

[52] U.S. Cl. ..... 336/96; 333/12; 333/185; 336/175; 336/212; 336/233

[58] Field of Search ..... 333/12, 25, 26, 32, 333/33, 181, 182, 184, 185; 336/96, 172, 173, 174, 175, 212, 221, 233, 234

[56] References Cited

U.S. PATENT DOCUMENTS 1,880,805 10/1932 Christopher ..... 336/234
3,613,033 10/1971 Denes ..... 333/182

*Primary Examiner*—Thomas J. Kozma
*Attorney, Agent, or Firm*—Frank A. Steinhilper

[57] ABSTRACT

An electronic noise suppressor has a U-shaped wire or other conductor passing through two stacked ferrite beads. The bead near the legs of the conductor is of high frequency impedance and the bead at the head of the U is of low frequency impedance. The legs of the U-shaped conductor are connected into an electronic circuit in which noise is to be suppressed.

5 Claims, 8 Drawing Figures

FIG. 1
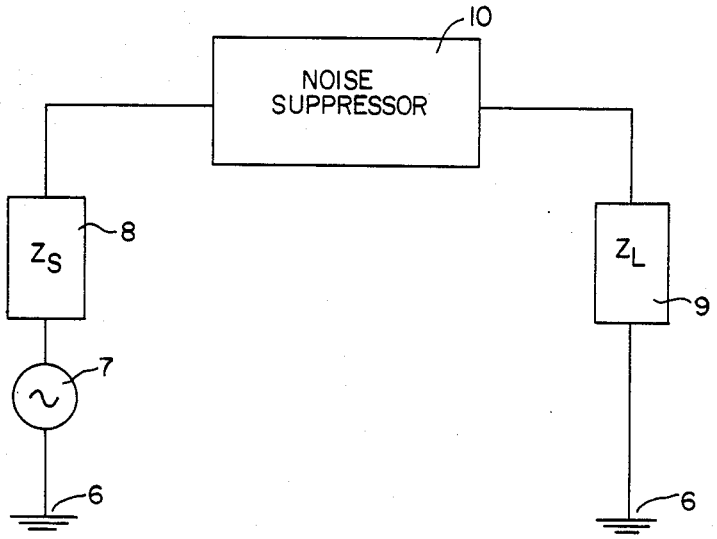
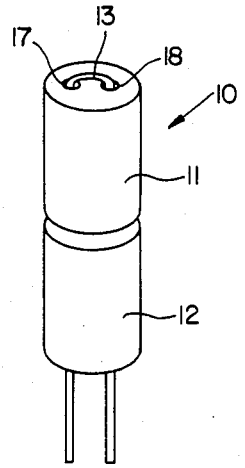
FIG. 2
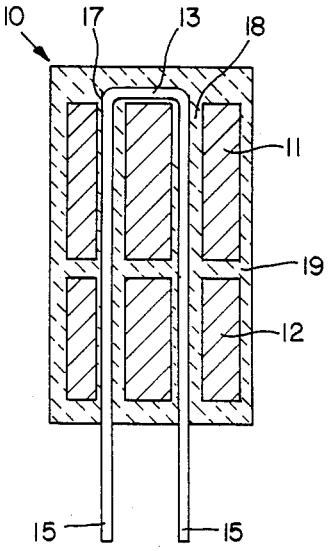
FIG. 3
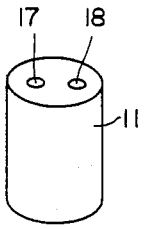
FIG. 4

ELECTRONIC NOISE SUPPRESSOR

BACKGROUND OF THE INVENTION

It is frequently desired to supress noise in electrical and electronic circuits, usually relatively high frequency noise, and this is generally difficult and expensive. For example, it can be accomplished by the use of several stages of filters or other means which may be effective but which are unduly cumbersome or expensive, usually both. Accordingly there is a need for a noise supressor which is simple, inexpensive and easy to use. The present invention relates to such an inexpensive and simple element and to its use for noise supression in electronic circuits.

One of the problems with attenuation or suppression of noise in such circuits and devices is that relatively high frequency noise which needs to be supressed is often noise over a broad frequency range, and devices which cover these relatively broad bands are usually complex in design and at least are expensive to make. For example, in uses and applications where a few cents apiece is a significant additive cost, elaborate or multiple stage filters are at best inappropriate. One effort to overcome some of the problems and difficulties is shown, for example, in U.S. Pat. No. 3,781,740, wherein a choke is proposed for impulse-like interference voltages, the choke having two annular partial cores. While this may bring about a significant cost savings compared with previous ways of reducing noise, the element shown in that patent is still expensive in terms of many common usages and is more awkward to use than would be desirable.

GENERAL NATURE OF THE INVENTION

According to the present invention two small beads of ferrite material are placed together, one on top of the other, with two or more holes or passageways through the two beads sequentially. A U-shaped conductor, such as a U-shaped wire is inserted in these holes, and the resulting wired beads are protected and are fixed in structure and design by a suitable coating such as, for example an epoxy or other resin by which the bead may be encapsulated in a protective case. The device itself is characterized by having a lower body of a first ferrite material whose impedance is characteristically high over a first frequency band and an upper body of a second ferrite material whose impedance is characteristically high over a different frequency band. Desirably the impedance of the first ferrite may be reduced in a frequency range where the impedance of the second ferrite is increasing. The device can be made operable by configuring it with either ferrite material as the lower body, but best results are obtained with the lower body having higher frequency impedance and the upper body having lower frequency impedance.

The terms "upper" and "lower" are herein used in the manner conventional in the art, the term "lower" referring to the bead nearer the legs of the device and the term "upper" referring to the bead closer to the bent portion or head of the U-shaped conductor.

In a presently preferred form of the invention, a first bead is formed from a nickel zinc ferrite which has high frequency impedance, a second bead is formed from a manganese zinc ferrite which has low frequency impedance, and two closely adjacent parallel holes are formed through the two beads. The beads are stacked and a U-shaped wire or other conductor is fitted through the bead holes, with the manganese zinc ferrite closely surrounding upper portions of each leg of the conductor or the head of the device, and the nickel zinc ferrite closely surrounding the lower portions of each such leg. The resulting bead desirably is dipped or encapsulated or otherwise coated or formed into a firm structure with a suitable resin or other hardening material, such as an epoxy resin or the like.

In this form a noise suppressor formed from a lower bead of a nickel zinc ferrite having high frequency impedance and an upper bead of a manganese zinc ferrite having low frequency impedance, produced a device with an extremely flat wideband impedance, its impedance being flat within about 0.6 db and almost purely resistive over a range from about 5 MHz to over 500 MHz. By comparison, the manganese zinc ferrite alone had an impedance peaking at about 5 MHz and falling sharply at frequencies below or above about 5 MHZ, while the nickel zinc ferrite alone had a peak impedance at about 500 MHz, falling significantly below that frequency.

By contrast with the device having the manganese zinc ferrite at the head of the device, when the positions of the two beads was reversed by placing the manganese zinc in the lower position, the impedance of the combined bead structure was high from about 5 MHz to about 200 MHz, falling gradually above that frequency, and being substantially lower at 500 MHz.

The noise suppressor of this invention is simple and easy to install in an electronic circuit or device, and its manufacturing cost is very little more than that of a single-ferrite bead and is far less than other means of electronic noise suppression. In particular, it is convenient for installation and for insertion in tape and reel fed equipment and is useful in many devices and apparatus which are subject to interfering electronic noise.

Usually the two beads of high frequency ferrite and low frequency ferrite will be of approximately the same small size, with the low frequency ferrite in the upper position and the high frequency ferrite in the lower position, but the frequency impedance of the device may be tailored to specific needs by varying the size of one or the other ferrites or by other means apparent to those skilled in the art. It is also to be understood that various high and low frequency impedance ferrites are commercially available from numerous manufacturers or may be specially made to provide certain desired individual frequency responses.

The general nature of the invention having been set forth, the invention may be more fully understood in connection with the drawings in which:

FIG. 1 is a diagrammatic view of an electronic circuit having a noise suppressor according to one embodiment of the invention.

FIG. 2 is a perspective view of a noise suppressor member according to one embodiment of the invention, without encapsulation.

FIG. 3 is a front cross sectional view of an encapsulated noise suppressor member having the structure of the member of FIG. 2.

FIG. 4 is a perspective view of one of the beads of the member of FIG. 2.

SPECIFIC DESCRIPTION OF THE INVENTION

Figure 5:
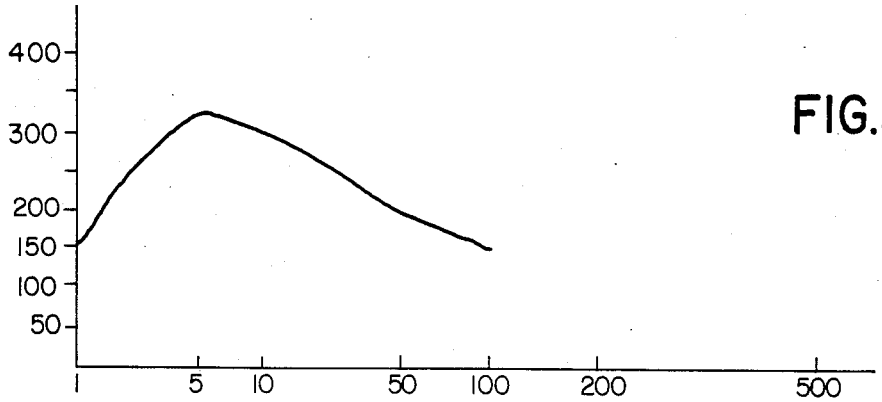
FIG. 5 is a curve showing the impedance vs. frequency characteristics of a low frequency impedance material such as that for a first bead of the member shown in FIG. 2.

In FIG. 1 is shown a circuit having a common ground 6, an AC voltage source 7, source impedance Zs, 8, load impedance Zl, 9, and a noise suppressor 10 according to the present invention.

One embodiment of the invention is illustrated in FIGS. 2, 3 and 4, wherein a noise supressor generally designated 10 has a U-shaped wire or conductor 13 fitted through two beads 11 and 12 of magnetic material such as, for example, two ferrite beads. As shown in FIG. 2, a first bead 11, shown in what is known as the upper position, and a second bead 12, shown in the what is known as the lower position, have a U-shaped wire 13 passing through parallel holes 17 and 18 in the beads (see FIGS. 2 and 3 for illustrations of these holes). The wire ends 15 are suited to be connected to desired electrical or electronic circuits. In FIG. 3 is shown the internal structure of the member 10, having beads 11 and 12 stacked, or positioned one on top of the other, with a pair of holes 17 and 18 passing through both beads to form channels or passageways. Wire 13 passes through the holes 17 and 18, entering through hole 17 in lower bead 12, passing through upper bead 11, continuing out of and across the top of bead 11 and re-entering upper bead 11 through hole 18, continuing through lower bead 12 and exiting therefrom. The legs of the U-shaped conductor extend out from lower bead 12 and are suited for connecting into electric circuits as desired. An outer layer such as a coating 19 of a resin or the like protects the assembly during handling and use.

FIG. 4 shows one of the beads, for example, upper bead 11, having two holes or passages 17 and 18 passing lengthwise therethrough.

Upper and lower beads 11 and 12 are made of suitable low frequency and high frequency materials. One type of such material which is readily available commercially, which is relatively small and which forms inexpensive small noise suppressors for many purposes and uses in electronic circuitry, is ferrite. As is well known, ferrite is a magnetic ceramic material comprising a large quantity of iron oxide with other modifying elements therein. In a preferred embodiment of the invention bead 11, or the upper bead, is a ferrite material characterized by having high impedance through a lower frequency range while bead 12, or the lower bead, is a ferrite material characterized by having high impedance through a higher frequency range. One suitable combination uses as a low frequency material a manganese-zinc ferrite and as a high frequency material a nickel-zinc ferrite. Other materials may be used to achieve the combination of low frequency impedance in bead 11 and high frequency impedance in bead 12, but at present the manganese-zinc and nickel-zinc ferrites are preferred, as offering a combination of simplicity of structure, small physical size, effectiveness of result and significant economy of construction. Suitable low frequency manganese zinc ferrites are commercially available, and one such material is available under the name "B material" from Ferronics, Inc., East Rochester, N.Y. A frequency-impedance curve for such a material is shown in FIG. 5. Suitable high frequency nickel zinc ferrite materials are available commercially, and one such material is available under the name "J material" from Ferronics, Inc., East Rochester, N.Y. A frequency-impedance curve for such a material is shown in FIG. 6.

Referring now to FIG. 5, the quantity signified by the numbers for impedance are not important as the quantitative number depends on size, shape and other factors; slopes and the peaks of the curve are the significant observations. It is observed that the impedance rises from a low value at 1 MHz to a point above 300 at about 4 MHz, peaking at about 5 MHz and dropping sharply after about 6 MHz. A noise suppressor composed solely of this material would be a suitable suppressor for noise whose greatest intensity occurs at or near 5 MHz.

Figure 6:
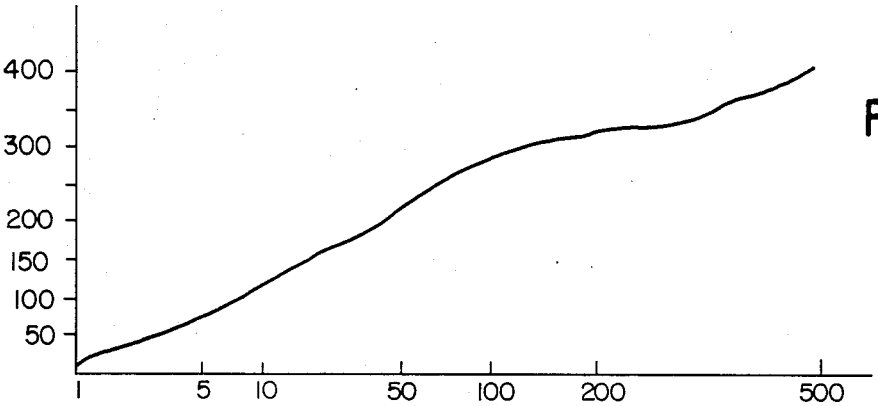
FIG. 6 is a curve showing the impedance vs. frequency characteristics of a high frequency impedance material such as that for a second bead of the member shown in FIG. 2.

Referring to FIG. 6, it is observed that the impedance of this material is low at low frequencies and rises relatively sharply and rather steadily up to at least 500 MHz. A noise suppressor composed solely of this material would be a suitable suppressor for frequencies substantially higher than the 5 MHz frequency appropriate for the manganese zinc ferrite.

It has been found to be unexpectedly important that upper bead 11 be the bead characterized by low frequency impedance and lower bead 12 be the bead characterized by high frequency impedance. Equivalent results are not obtained by reversing the positions of these two beads.

Figure 7:
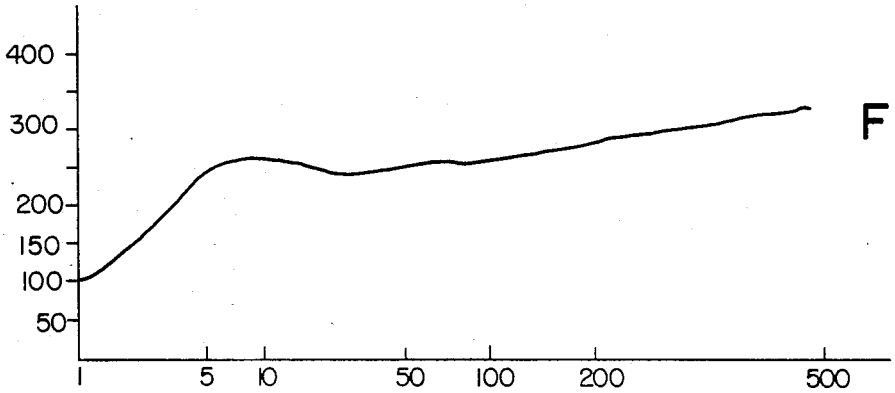
FIG. 7 is a curve showing the resulting impedance vs. frequency characteristics of the member shown in FIG. 2.

FIG. 7 shows a frequency-impedance curve for a noise suppressor such as that in FIG. 2, wherein upper bead 11 is a manganese zinc ferrite whose characteristics are illustrated in FIG. 5 and wherein lower bead 12 is a nickel zinc ferrite whose characteristics are illustrated in FIG. 6. It is observed that the noise suppressor 10 having this nickel zinc ferrite as bead 12 and this manganese zinc ferrite as bead 11 has a high, relatively flat impedance from a frequency about 5 MHz to a frequency at or above about 500 MHz.

Figure 8:
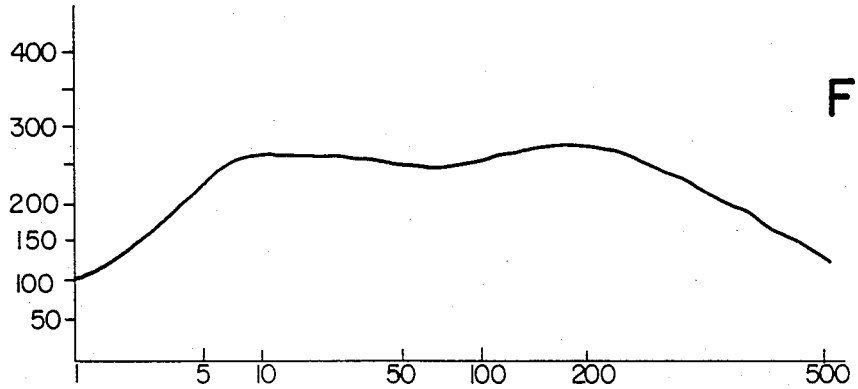
FIG. 8 is a curve showing the impedance vs. frequency characteristics of a member in which the positions of the two beads are reversed.

By comparison, FIG. 8 shows a frequency-impedance curve for a noise suppressor of like physical dimensions and like structure except that the locations of the beads are inverted and the nickel zinc ferrite is upper bead 11 and the manganese zinc ferrite is lower bead 12. As is apparent from the curve in FIG. 8 the impedance begins to decrease at frequencies above about 250 MHz. and is significantly lower than that of FIG. 7 at a frequency of about 500 MHz.

It is to be understood that numerous modifications and variations may be made in the form, size, structure and material composition in the device of this invention depending on the desired impedance characteristics of the device. As has already been set forth, the impedance characteristics can be modified by inverting the locations of the high frequency and low frequency beads. Such inversion seems to reduce the effective high frequency impedance of the device. Larger or small beads may be used in one position or the other, to change the resulting impedance at different frequencies. In addition, there are many ferrite materials commercially available, and others can be specially manufactured for specific desired results. For example, typical batch percentages or weight proportions of a nickel zinc ferrite may include about 66% iron, about 20% zinc, about 10% nickel and perhaps smaller amounts of or traces of other elements such as copper, magnesium or other elements. These constituents and proportions can be varied according to desired impedance characteristics. Similarly a typical manganese zinc ferrite may have about 55 to 60% iron, about 10% zinc and the remainder manganese plus other trace elements. Ferrite materials other than the named nickel zinc ferrite and manganese zinc ferrite may also be employed, again depending on specific desired results. However, the embodiment shown in the Figures and described herein produces excellent results for relatively flat impedance characteristics though the range of frequencies between about 5 MHz. and about 500 MHz., this being a commonly desired frequency range for noise suppression.

I claim:

1. A device for broadband attenuation of high frequency electronic circuitry noise comprising a bead having a first core body of a first ferrite having characteristically higher frequency impedance, a second core body of a second ferrite having characteristically low frequency impedance, said first and second core bodies being stacked one on another, closely spaced passages through both of said bodies and a U-shaped conductor fitted within and through said passages, passing from one end of said conductor first through said first body, next through said second body and then reversing back through said second body and through and exiting from said first body, and a resin coating binding said core bodies and conductor firmly into a double wired bead.

2. A device for broadband attenuation of electronic circuitry noise in a frequency range between about 5 MHz and about 500 MHz said device comprising a bead having a first core body of a first ferrite having characteristically high impedance within the upper portion of said frequency range, a second core body of a second ferrite having characteristically high impedance within the lower portion of said frequency range, closely spaced passages through both of said bodies and a U-shaped conductor fitted within and through said passages, passing through first mating passages in both of said bodies and reversing back through second mating passages in both of said bodies and a resin coating binding said core bodies and conductor firmly into a double wired bead.

3. The device of claim 2, wherein said broadband attenuation range is between about 5 MHz and about 500 MHz, and wherein said broadband attenuation is substantially flat throughout said range.

4. The device of claim 1, wherein said first ferrite is a nickel zinc ferrite and wherein said second ferrite is a manganese zinc ferrite.

5. The device of claim 2, wherein said second core body is positioned at the U-shaped portion of said conductor and wherein said first core body is positioned toward the extending legs of said U-shaped conductor.

* * * * *